US008826821B2

(12) United States Patent
Martin

(10) Patent No.: US 8,826,821 B2
(45) Date of Patent: Sep. 9, 2014

(54) EXPLOSIVES CONTAINER AND METHOD

(75) Inventor: Michael John Martin, Brookfield Queensland (AU)

(73) Assignee: Crinum IP Pty Ltd, Queensland (AU)

( * ) Notice: Subject to any disclaimer, the term of this patent is extended or adjusted under 35 U.S.C. 154(b) by 0 days.

(21) Appl. No.: 13/390,820

(22) PCT Filed: Aug. 23, 2010

(86) PCT No.: PCT/AU2010/001082

§ 371 (c)(1),
(2), (4) Date: Feb. 16, 2012

(87) PCT Pub. No.: WO2011/020164

PCT Pub. Date: Feb. 24, 2011

(65) Prior Publication Data

US 2012/0145027 A1 Jun. 14, 2012

(30) Foreign Application Priority Data

Aug. 21, 2009 (AU) ..... 2009903977

(51) Int. Cl.

| | |
|---|---|
| ***F42B 3/087*** | (2006.01) |
| ***F42D 1/08*** | (2006.01) |
| ***F42D 1/14*** | (2006.01) |
| ***F42D 1/16*** | (2006.01) |

(52) U.S. Cl.
CPC .. *F42B 3/087* (2013.01); *F42D 1/16* (2013.01)
USPC ..... 102/324; 102/313; 102/331; 383/40; 220/495.01

(58) Field of Classification Search
USPC ..... 102/313, 314, 317, 318, 320, 322, 323, 102/324, 331, 332, 312, 321, 282; 220/495.01, 495.06; 383/38, 40
See application file for complete search history.

(56) References Cited

U.S. PATENT DOCUMENTS

| | | | | |
|---|---|---|---|---|
| 1,543,850 | A * | 6/1925 | Holderer | 102/323 |
| 1,543,851 | A * | 6/1925 | Holderer | 102/323 |
| 2,920,523 | A | 1/1960 | Barco et al. | |
| 3,361,023 | A | 1/1968 | Collins et al. | |
| 3,837,279 | A | 9/1974 | Cooke | 102/24 |
| 4,282,812 | A | 8/1981 | Forgey et al. | 102/318 |
| 4,505,201 | A * | 3/1985 | Abele | 102/324 |
| 4,787,316 | A | 11/1988 | Drury et al. | 102/323 |
| 4,872,408 | A * | 10/1989 | Marz | 102/324 |
| 5,259,316 | A | 11/1993 | Nelson et al. | 102/312 |
| 7,819,063 | B1 * | 10/2010 | Lehman | 102/301 |
| 8,123,027 | B2 * | 2/2012 | Kirkham | 206/3 |

OTHER PUBLICATIONS

International Search Report and WO for PCT/AU2010/001082 issued on Oct. 29, 2010.
Australian Patent Office International Type Search Report for related application AU2009903977 issued on Jul. 20, 2010.

* cited by examiner

*Primary Examiner* — James Bergin
(74) *Attorney, Agent, or Firm* — Ladas & Parry, LLP

(57) ABSTRACT

An explosives container comprising a flexible inner bag within a flexible outer bag, the outer bag comprising a first end and a second end and a booster compartment located on an external surface of the outer bag, adjacent the second end. An explosive composition can be located within the inner bag and, in use, the booster compartment contains an explosive booster and serves to maintain the explosive booster in close contact with the explosives composition. The explosives container further comprises an elongate sheath extending substantially between the first end and the second end of the outer bag and serving to house and protect a detonator cord from damage or dislodgement.

18 Claims, 4 Drawing Sheets

EXPLOSIVES CONTAINER AND METHOD

CROSS-REFERENCE TO RELATED APPLICATIONS

This application is the U.S. National Stage of International Patent Application No. PCT/AU2010/001082 filed on Aug. 23, 2010, which claims priority to Australian Patent Application No. 2009903977 filed on Aug. 21, 2009 the disclosures of which are hereby incorporated by reference in their entireties.

FIELD OF THE INVENTION

The present invention is concerned with an apparatus and method for containing and locating an explosive composition. More particularly, this invention relates to a container to hold explosive compositions and related initiating devices and a method of locating same in a borehole.

BACKGROUND OF THE INVENTION

In mining applications explosive compositions often need to be placed in boreholes/blastholes in defined depths and amounts. This helps ensure that the blast rock is broken down in the desired manner leaving rubble and muck pile or fragmentation which is as large as is manageable for more efficient and economical removal/further processing.

The results achieved by the blast are greatly affected by the size and shape of the actual blast rock. The practice of pre-splitting is commonly used to create relatively steep and smooth highwall faces for improved stability control over subsequent blasting. The pre-splitting process involves drilling a row of closely spaced boreholes along the line of the highwall which will only be filled with approximately one quarter to one third the explosive charge used in bench or production blastholes. The pre-splitting blasts should form cracks and fissures in the highwall without causing too much damage to the blast rock due to excess energy, also referred to as back break.

Since the boreholes drilled for pre-splitting are, in practice, the same size as those for production blasting the problem is created of how the correct, lesser, amount of explosives can be placed in the borehole at the correct depths for successful pre-splitting.

Currently, small columns of explosives known as decks are placed in the borehole and spaced from one another by the introduction of material such as gravel or drill cuttings or the use of introduced decking devices. In this manner the borehole is filled and portions of the explosives placed at the desired heights along its length. This is a relatively time consuming and labour intensive process involving the introduction of large quantities of filler material. Further, each deck of explosives generally has a primer or booster of some kind which must rest within or adjacent the explosive composition. Placement and maintenance of this device in each deck can be problematic since the ensuing filler can damage or re-locate the booster and effectively separate it from the charge.

There are further problems if the borehole is completely or partially filled with water, as can often happen. In this situation, after the explosive charge has been placed in the borehole, the booster is introduced and essentially dragged through the explosives in the hope that it will lodge sufficiently for successful later blasting. Even in stagnant water this process is less than ideal but in boreholes containing dynamic water it is extremely unreliable and the booster is frequently dislodged or the dynamic water may actually wash away the explosive charge before detonation can take place.

If the booster does not lodge successfully within the explosive charge or the charge is washed away then the result may be a misfire. This is a very costly process as the borehole will have to be cleared and possibly re-drilled. This is a serious drain on man hours and greatly increases the expense of mining an area.

OBJECT OF THE INVENTION

It is an object of the invention to overcome or alleviate one or more of the above disadvantages or to provide the consumer with a useful or commercial choice.

SUMMARY OF THE INVENTION

According to one form, although not necessarily the only or broadest form the invention resides in an explosives container comprising:

(a) a flexible outer bag comprising a first end and a second end; and (b) a booster compartment adapted to contain an explosive booster, the booster compartment located on an external surface of the outer bag, adjacent the second end.

The explosives container may further comprise a flexible inner bag located within the outer bag.

Preferably, the outer bag is elongate.

If required, the outer bag may further comprise an elongate sheath extending substantially between the first end and the second end.

Preferably, the outer bag is provided with an opening at the first end and is sealed at the second end.

Suitably, the first end of the outer bag is provided with a fastener to close the opening therein.

A plurality of apertures may be formed in the first end of the outer bag.

Preferably, the plurality of apertures is two pairs of spaced apertures.

Suitably, the outer bag further comprises a secondary sheath.

Preferably, the secondary sheath is located beneath the booster compartment.

The booster compartment may have an opening adjacent the lower extent of the elongate sheath.

Preferably, the opening of the booster compartment is closable using a compartment fastener.

If required, the compartment may be provided with a compartment aperture in a wall thereof.

Preferably, the inner bag is water resistant or waterproof.

According to another aspect of the invention there is provided a method of locating an explosive composition in a borehole including the steps of:

(a) placing the explosive composition into a flexible inner bag, the inner bag located within a flexible outer bag and the outer bag having a first end and a second end and a booster compartment located on an external surface of the outer bag, adjacent the second end;

(b) placing an explosives booster into the booster compartment; and (c) lowering the outer bag into the borehole to thereby locate the explosive composition in the borehole at a desired depth.

Suitably, the outer bag may further comprise an elongate sheath extending substantially between the first end and the second end.

A detonator cord may be located within the elongate sheath.

In a further embodiment there is provided a method of locating an explosive composition at a desired depth in a borehole comprising the steps of:

(a) providing a container comprising a flexible outer bag having a first end and a second end, an opening provided in the first end, a booster compartment located on an external surface of the outer bag, adjacent the second end and a flexible inner bag located within the outer bag;
(b) providing a locating device having a tensioning device and a line support;
(c) suspending the container on the locating device, over the borehole;
(d) placing the explosive composition into the inner bag, through the opening of the outer bag;
(e) attaching a first end of a line to the first end of the container, the line being frictionally engaged with the line support and a second end of the line being releasably attached to the tensioning device; and
(f) releasing the second end of the line from the tensioning device and lowering the container into the borehole to thereby locate the explosive composition at a desired depth in the borehole.

Preferably, the line support is a track, pulley or frictional device.

Suitably, the outer bag further comprises an elongate sheath extending substantially between the first end and the second end.

The container may be suspended on the locating device with one or more projections extending through apertures formed within the outer bag.

The locating device may have a plurality of legs.

Alternatively, the locating device may be the arm of a vehicle mounted crane.

As the container is lowered the line passes through and remains frictionally engaged with, the line support.

The container may be lowered automatically by means of the line passing through a winch or like device.

Preferably, an explosives booster is placed in the booster compartment.

Suitably, the outer bag may further comprise an elongate sheath extending substantially between the first end and the second end.

A detonator cord may be located within the elongate sheath to maintain the detonator cord adjacent the explosives booster.

Further features of the present invention will become apparent from the following detailed description.

Throughout this specification, unless the context requires otherwise, the words "comprise", "comprises" and "comprising" will be understood to imply the inclusion of a stated integer or group of integers but not the exclusion of any other integer or group of integers.

BRIEF DESCRIPTION OF THE FIGURES

In order that the invention may be readily understood and put into practical effect, preferred embodiments will now be described by way of example with reference to the accompanying figures wherein like reference numerals refer to like parts and wherein.

DETAILED DESCRIPTION OF THE INVENTION

The terms "explosives booster" and "booster" as used herein encompass any kind of explosive device which can be employed to detonate a larger, generally more powerful, explosive charge. These devices are well known in the art and, generally, comprise a low energy explosive to increase the energy of an initiating explosive to a level sufficient to trigger explosion of the low sensitivity/high energy main explosive charge, such as ANFO. Non-limiting examples of such devices include compositions comprising RDX (cyclotrimethylenetrinitramine), PETN (pentaerythritol tetranitrate), TNT, various explosive emulsions and the like.

The term "detonator cord" as used herein may refer to any cord which is capable of transmitting sufficient energy to initiate explosion of the booster. The use of this term herein includes those cords having an explosive core of PETN or the like as well as electrical detonators which employ a length of wire or fuse of some kind which is subjected to an electric discharge to propagate a shock wave which ends in a detonator charge, or blasting cap, sufficient to initiate explosion of the booster. The use and varieties of such detonator cords is well understood in the art.

Figure 1:
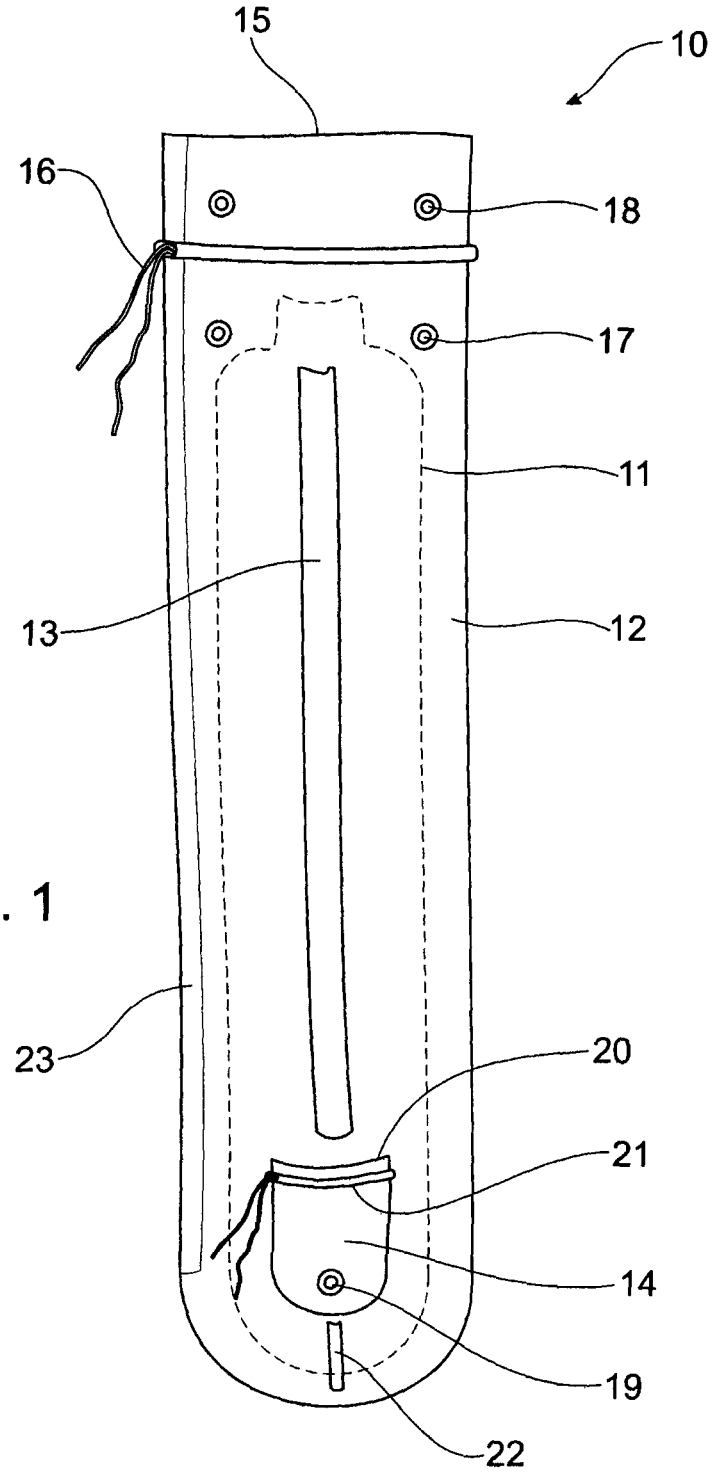
FIG. 1 shows one embodiment of an explosives container.

FIG. 1 shows one embodiment of an explosives container suitable to contain a desired quantity of explosives to be located in a borehole. The explosive container 10 comprises a flexible inner bag 11 (shown in outline/broken line) which is encapsulated within a tougher but flexible outer bag 12. Outer bag 12 has, on its external surface, an elongate sheath 13 which extends longitudinally along a substantial portion of the length of the outer bag 12. The elongate sheath 13 is adapted to house a detonator cord and maintain the detonator cord adjacent the explosives booster.

A booster compartment 14 is located below the lower extent of elongate sheath 13 and, in the embodiment shown, takes the form of a pocket or enclosure. Booster compartment 14 is adapted to house an explosives booster or like explosives initiating device and maintain the explosives booster adjacent the explosives.

Outer bag 12 is provided with an opening 15 at its first or upper end and is sealed at its lower or second end. The opening 15 of outer bag 12 may be closed via one or more fasteners 16 which in the embodiment shown in FIG. 1 is a draw cord extending around the perimeter of outer bag 12. The first end of the outer bag 12 is also provided with a number of apertures which in the embodiment shown take the form of spaced pairs of eyelets being lower eyelets 17 and upper eyelets 18. These eyelets, 17 and 18, are apertures whose border is reinforced with a metallic ring preferably being non-ferrous.

Booster compartment 14 is provided with a compartment aperture, which in the embodiment shown takes the form of compartment eyelet 19, as well as a compartment opening 20 which is sealable by compartment fastener 21. Outer bag 12 is also provided with a secondary sheath 22 which is smaller in length than the elongate sheath 13 and is located at the second end of outer bag 12, below booster compartment 14.

Outer bag 12 may be constructed from one sheet of material which is stitched, adhered, heat sealed or otherwise affixed along seam 23. Inner bag 11 may be constructed in a similar manner.

Outer bag 12 is constructed from a tough but flexible puncture resistant material such as a woven polypropylene fabric.

Other suitable materials may include polymeric films; knitted, woven or non-woven fabrics of polymeric materials such as polyolefins, polyesters, polyamides and polyurethanes; glass fibre, carbon fibre, KEVLAR™ or like high tensile fibres; natural fibres such as cotton, jute, hemp and the like or mixtures thereof.

Preferably, outer bag 12 is made from a high tensile woven polypropylene.

In instances where the explosive composition is sensitive to water then flexible inner bag 11 is made from a water resistant or waterproof material and may be sealed after insertion of the explosives to prevent or slow the ingress of dynamic water. The inner bag 11 may be formed by a heat welding process from a polyethylene, polypropylene, nylon film or a co-extrusion such as nylon/surlyn or polyethylene/nylon/polyethylene or may be manufactured from a range of materials including a seam welded bag fabricated from a laminate of films of Nylon or Nylon copolymers with an m-LLDPE sealant film.

Preferably, the inner bag 11 is formed from PET (polyethylene terephthalate) film alone or in coextrusion or laminate with one or more other polymer films.

In use, a required amount of the explosive composition, which is normally a flowable mixture, will be pumped or otherwise introduced into the confines of inner bag 11. The opening of inner bag 11 is then sealed by means of a draw cord, adhesive, heat sealing, Velcro or like means which will keep water out or at least slow its ingress. Once sealed, inner bag 11 is thus adapted to substantially prevent any explosive composition from exiting container 10. Fastener 16 is then tensioned to close opening 15 of outer bag 12. This ensures that all of inner bag 11, and hence the explosive, is protected by the tough outer bag 12.

This ability to contain the explosives composition and effectively partition it from the external environment of the borehole is one advantage of the present invention. Many flowable explosive emulsion compositions contain surfactants, emulsifiers and the like to maintain them in an intimately mixed state. If a borehole has explosives directly introduced and they are then left to sit (sleep) for a long period of time then the explosives can start to phase separate or split which results in a poor explosion profile upon detonation. This separation is greatly encouraged by drilled cuttings such as clay and rock pieces lying in the borehole which effectively draw the explosive composition into the cuttings and thereby absorb or separate the emulsifiers and other components from the main explosive material. By locating the explosive composition within sealed inner bag 11 of container 10 it is effectively prevented from interacting with the surrounding environment and so the purity and integrity of the composition is maintained thus reducing the likelihood of a poor explosion profile or no explosion at all. This presents great savings to the user as explosive composition is one of the greatest ongoing costs in blasting.

The flip side of this is that it is not necessary to have, a dry borehole before explosives can be placed since the presence of water (stagnant or dynamic) will not reduce the effectiveness of the blast when employing container 10 of the invention. Considerable time is often wasted in pumping out boreholes containing stagnant water and the expelling of the water onto the area surrounding the borehole can be a safety hazard. These issues are avoided when the explosive composition is isolated within the confines of container 10.

An explosives booster (not shown) is then placed into booster compartment 14 via compartment opening 20. Booster compartment 14 is shown in the embodiment described as being located at the lower, second end of outer bag 12 to ensure that however small an amount of explosive composition is used the booster will sit adjacent to this to ensure successful firing. However, booster compartment 14 may, in theory, be located anywhere on the exterior of outer bag 12 or, indeed, even on the interior of said bag, for 'toe' charges or 'mid' and 'top' hole charges, although this will be considerably less convenient when locating the detonator cord. Compartment opening 20 can be closed by tensioning of compartment fastener 21 which ensures that the booster cannot be displaced even if the borehole is filled with dynamic water. The effect is to maintain the booster adjacent the explosives or integral with the toe charge and thereby increase the likelihood of successful firing of the borehole.

A detonator cord can be run down through the hollow interior of elongate sheath 13 and connected to the booster. Elongate sheath 12 acts to protect the detonator cord along its length and lessen the risk of it being snagged and displaced from the booster during placement in the borehole.

In one embodiment a series of containers 10 can be located within a borehole, one above the other, spaced to the desired degree. In this situation it may be convenient to have a single detonator cord running between them all with the same cord thread to each booster. For this reason booster compartment 14 may be provided with compartment eyelet 19 through which the detonator cord can exit after connection to the first booster. The detonation cord would then pass through secondary sheath 22 before being fed into the elongate sheath of the next container. It may only be necessary to provide a booster in the lowest container 10, if containers 10 are engaged, within the borehole and simply run the detonation cord up the secondary and elongate sheaths of the containers 10 placed above but if the containers are disengaged i.e. spaced, then it is preferable that each will contain a booster. This provides a simple and efficient means of preparing a series of containers which can then be located, one by one or simultaneously, into a borehole.

Figure 2:
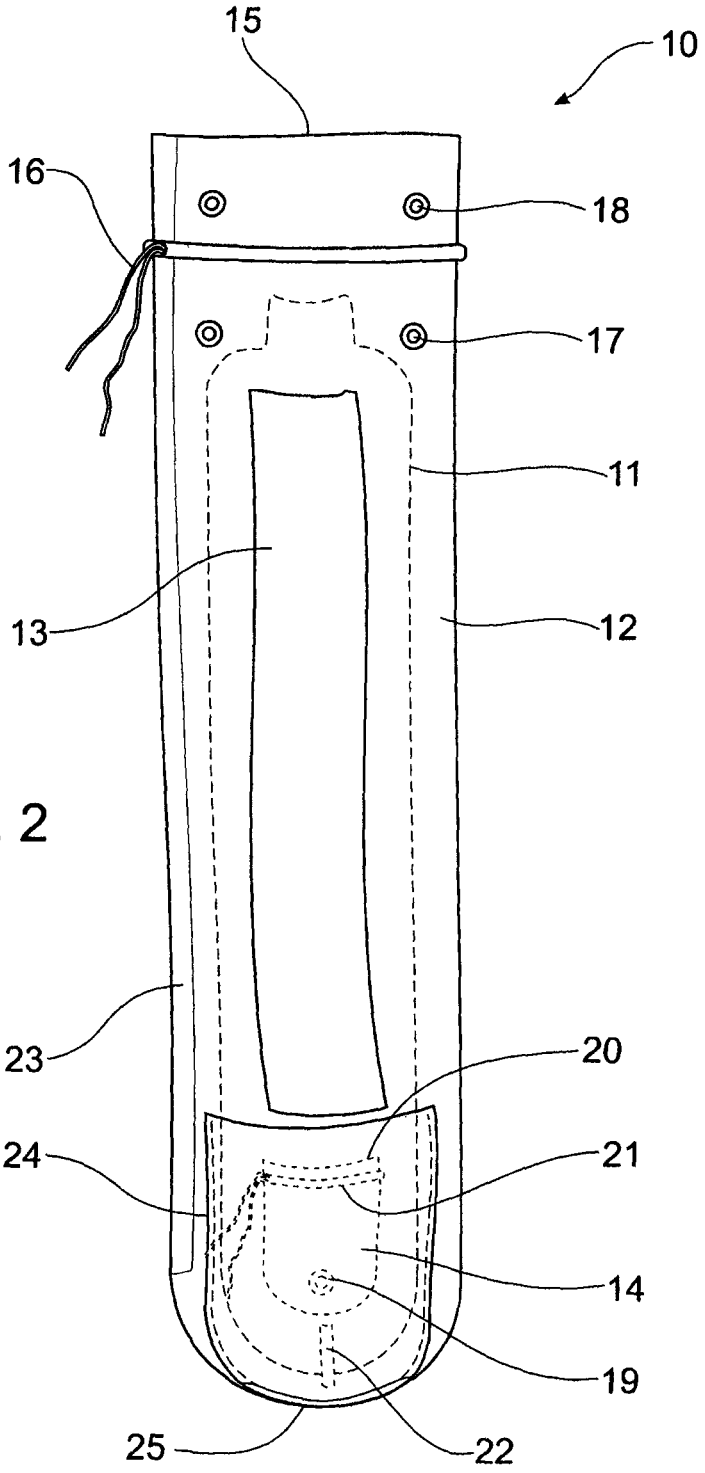
FIG. 2 shows a further embodiment of an explosives container.

FIG. 2 shows a further, preferred, embodiment of an explosives container 10. Explosives container 10 shown in FIG. 2 is similar in design to that in FIG. 1, apart from the important features of the dimensions of elongate sheath 13 and the introduction of a protective cover being a pouch 24, and so the numbering has been made consistent between the two.

Container 10, shown in FIG. 2, has an elongate sheath 13 located substantially between lower eyelets 17, at its upper extent, and pouch 24, at its lower extent. Elongate sheath 13 is formed from an elongate piece of material, similar in nature to that forming outer bag 12, stitched along its right and left longitudinal extents to the outer surface of outer bag 12. Elongate sheath 13 is thus open at both its upper and lower extent to form a tunnel or hollow sheath. The openings and length of the interior of elongate sheath 13 are of a size suitable to accommodate a human hand. Particularly, the interior of elongate sheath 13 is of a size which can comfortably accommodate a gloved human hand which enables a worker in the field to more conveniently insert and thread through a detonator cord thereby saving operational time and increasing the likelihood of compliance/proper usage. Otherwise, elongate sheath 13 acts in an identical manner to and provides all of the advantages of the same component shown and described in relation to FIG. 1.

In FIG. 2, booster compartment 14, and associated features, as well as, optionally, secondary sheath 22 are located within an interior of pouch 24 and are thus shown in outline/broken lines only. Pouch 24 is made from material the same as or similar in nature to that forming outer bag 12 and is stitched along its right and left sides, as well as a portion of its underside, to the outer surface of outer bag 12. A portion of the underside or lower extent of pouch 24 has not been stitched to outer bag 12 to form open portion 25. Pouch 24 is thus open at its upper and lower extents. Open portion 25 will be large enough to accept a human hand to aid in feeding detonator cord through to booster compartment 14.

Pouch 24 thus forms an open compartment or pocket and acts as an additional protective shield to the booster device within booster compartment 14. The design of pouch 24 means it does not project outwards from the surface of outer bag 10 to any significant degree and so the chances of this region of container 10 becoming snagged on a rough section of borehole wall are greatly decreased. The integrity of booster compartment 14 and the booster contained therein are thus ensured.

Although not detailed in FIG. 1 or 2, a further advantageous feature of the present invention results from the manner of attachment or design of booster compartment 14. Booster compartment 14 may be a fully formed pocket or open purse design which is then attached to outer bag 12. This means that when the booster is located within booster compartment 14 the tensioning of compartment fastener 21, which may be a draw cord or similar means, causes outer bag 12 to be drawn around booster compartment 14 to an extent. This process can also be thought of as drawing booster compartment 14 into the body of outer bag 12 such that, when container 10 is filled with explosives, the border formed by the outer surface of outer bag 12 contains within it, booster compartment 14. When explosives container 10 has been at least partially filled with explosives and it is viewed from overhead i.e. looking straight down on opening 15 with open portion 25 substantially in alignment with opening 15, then the outer surface of outer bag 12 would substantially resemble a cylinder with booster compartment 14 at least partially situated within the border of that cylinder.

This drawing of the booster device into closer contact with the explosives composition is important to maximise its initiating effect on the explosives to give the desired blasting effect and also to reduce fume from the incomplete combustion of the explosives composition. If the booster device is simply adjacent container 10 then, when the booster is initiated, much of its force is unnecessarily expended on surrounding rock of the borehole wall or floor. This can lead to a lower combustability and rate of explosion, particularly in increasing depths in wet boreholes where the charge will be partially dampened by the hydrostatic pressure. This can lead to increased fume production. The effect provided for by booster compartment 14 whereby the booster is effectively drawn into the explosive composition, while still separated by inner 11 and outer 12 bags, means a greater proportion of the initiating force is directed straight into the body of the explosives and so the success rate of initiation is improved.

Figure 3:
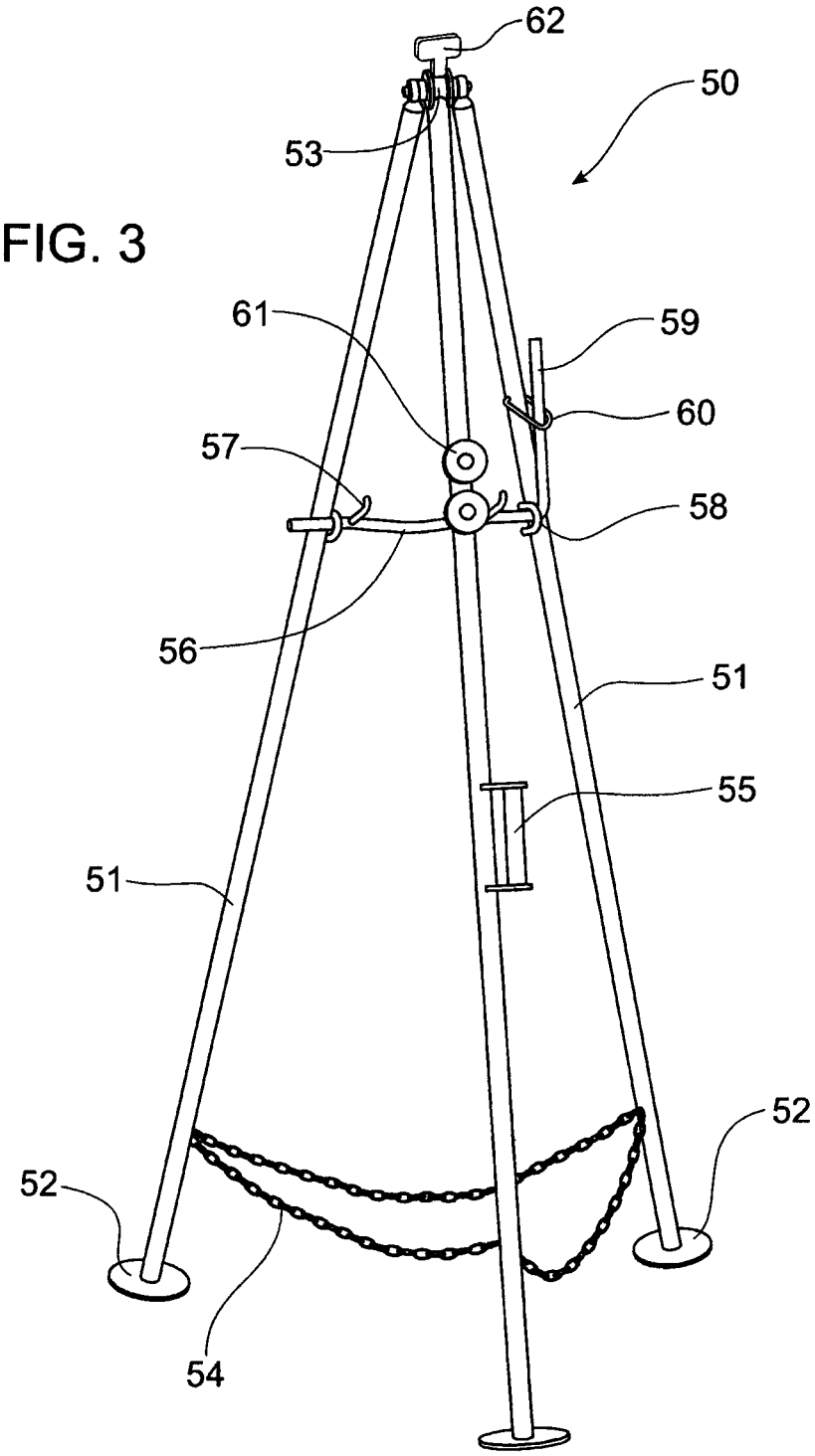
FIG. 3 shows a perspective view of one embodiment of a locating device.

FIG. 3 shows a perspective view of a locating device 50 according to an embodiment of the invention. Locating device 50 comprises a plurality of legs 51 which end at their lower extent in feet 52, forming a stable contact with the ground, and are joined at their upper extent to a line support 53. In one embodiment, feet 52 are adjustable and/or legs 51 may have a telescopic portion to allow adjustment for stability on uneven ground. Chain 54 restricts the legs 51 from moving beyond a certain distance relative to one another to maintain locating device 50 in a stable upright position. Handle 55 is provided on one of the legs 51 so that the device can be easily transported when not in use.

An angled shaft 56 is fixed between two of the legs 51 and is provided with two projections or hooks 57. The angled shaft 56 is held in place by brackets or clevises 58 which are each attached to a leg 51 and its horizontal portion ends in a right angle to then form lever 59. A latch 60 is provided on the leg 51 adjacent lever 59 to lock the lever into place in an upright or substantially vertical position.

One of the legs 51 is also provided with a tensioning device which in the embodiment shown takes the form of two ties 61 which sit adjacent one another. A depth meter 62 is located above line support 53 and, in use, the line will pass through or in some manner engage with depth counter 62 so as to indicate to an operator the depth at which explosives container 10 has been placed. This helps ensure accurate placement of the explosives which is useful when the rock formation has been analysed and blasting at precise depths to coincide with particular strata can produce optimal results.

Locating device 50 can be constructed from a range of materials which provide sufficient strength to support weights of up to 100 kg but are relatively lightweight. By way of example only, locating device 50 may be constructed from metals such as iron, steel, aluminium alloys as well as reinforced plastics and/or polymers. Lightweight aluminium alloys and reinforced plastics are preferred.

The length of the legs 51 and the angle of their attachment to line support 53 will be such that locating device 50 can stably sit over an open borehole while leaving sufficient room underneath the line support in which to locate an explosives container 10.

Line support 53 is a simple track in the embodiment shown but may be a pulley or a similar device to those employed in abseiling and rock-climbing such as a friction-lock device, figure eight, tuber or any like means suitable for locating a line such as a string line, rope or cord and supporting and subsequently lowering a load in a controlled manner. The line support 53 should provide sufficient frictional engagement with the line or cord to slow its passage and aid in controlled lowering of the load. To further ease the lowering of explosives container 10 the line or rope may be attached to an automated device, such as a winch or like means, which is fixed in position and electronically operated to thereby take all of the strain involved.

Line support 53 can be formed in a number of ways which would be apparent to a person skilled in the art. In the embodiment shown the line support 53 is formed from a cross piece which is directly attached to one of the legs 51. Each end of the cross piece is provided with a ball and socket type joint by which the remaining two legs 51 are connected. Two flanges in the central region of the cross piece define a track between them through which a rope, cord or line of some description can be run to support the container 10 during lowering into the borehole.

Angled shaft 56 is angled such that the central region extends out towards legs 51 so as to leave sufficient clear space for container 10. When lever 59 is in the raised position, shown in FIG. 4, hooks 57 will project into the area defined between the plurality of legs 51 and present a partially vertical orientation. Latch 60 holds lever 59 in this position so that items placed upon hooks 57 cannot slide off until lever 59 is deliberately lowered and the orientation of hooks 57 changes appropriately.

In an alternative embodiment, locating device 50 may take the form of an arm of a vehicle mounted crane. Such small cranes or other projecting arms are well known in the art and provide a stable base for locating explosives container 10 over a borehole when it is not convenient to locate a tripod type structure due to, for example, drill cuttings piled up in the relevant area. The rest of the components described in relation to locating device 50 can easily be adapted to be present on such a crane or arm without the requirement for inventive input.

Figure 4:
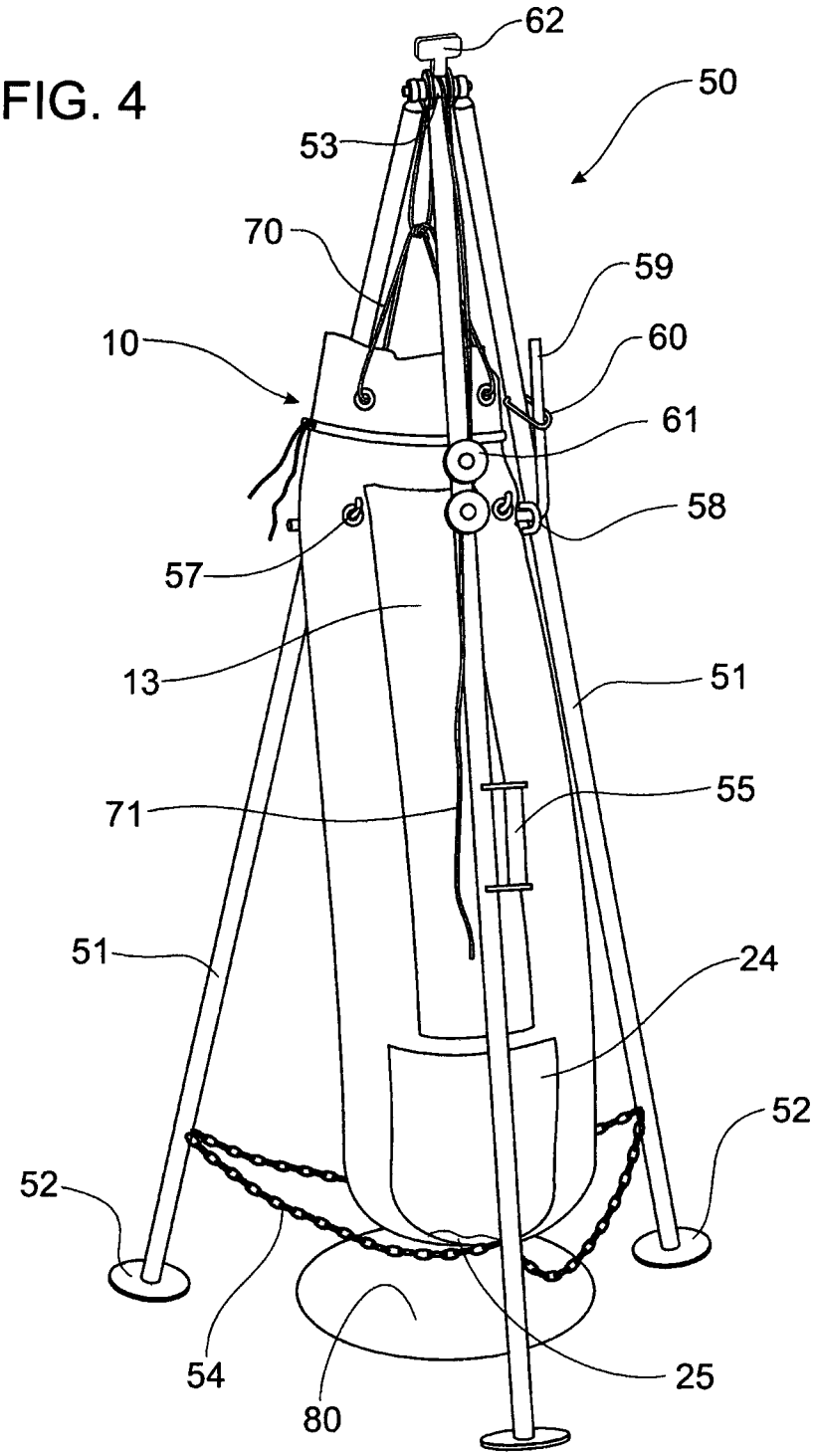
FIG. 4 shows a perspective view of the explosives container shown in FIG. 2 attached to the locating device shown in FIG. 3, in preparation for lowering the container into a borehole.

FIG. 4 shows a perspective view of explosives container 10 shown in FIG. 1 and locating device 50 shown in FIG. 3, in preparation for lowering container 10 into a borehole 80. Outer bag 12, when empty, is fixed onto locating device 50 by one or more projections, which in the embodiment shown in FIG. 4 are hooks 57, which project through pair of lower eyelets 17. A line, which in the embodiment shown is a rope or cord 70, has been attached at its first end to outer bag 12 by threading it through the pair of upper eyelets 18 and looping it such that outer bag 12 is slightly gathered at opening 15. Cord 70 is then run up one side of line support 53, through said support and down the opposite side to then be tied off on ties 61 close to its second end 71. The design of ties 61 is such that cord 70 is wrapped around one and then the other tie 61 in a figure of eight manner to thereby prevent accidental slippage of cord 70, but any like means will suffice.

At this point, filling of container 10 with an explosive composition can begin and container 10 will therefore start to develop a significant weight of between approximately 20-60 kg. Rather than requiring a person or persons attempt to lift this weight and thereby risk injury, the weight is immediately borne by the frame of locating device 50 to which container 10 is already attached. The booster and detonator cord will have been located in booster compartment 14 (hidden from view in FIG. 4 by pouch 24) and elongate sheath 13, respectively, as previously described. Cord 70 will be tensioned and then tied off on ties 61.

When it is desired to lower container 10 into borehole 80 latch 60 is raised to release lever 59 which can then be lowered. This lowering action causes rotation of angled shaft 56 which results in hooks 57 being both lowered and drawn out towards legs 51 thereby enabling them to simply slide out from the pair of lower eyelets 17 without the need for any manual lifting. The weight of container 10 and the explosive composition is effectively transferred to cord 70 which supports container 10 at the pair of upper eyelets 18. Cord 70 will become fully tensioned and container 10 can be lowered by unwrapping second end 71 of cord 70 from ties 61. At this point a person will be holding the second end 71 of cord 70 and lowering container 10 in a controlled manner but that user will not need to bear the full weight of container 10 and enclosed explosives due to the effect of line support 53. Line support 53 provides a resistance or friction control to enable easy and controlled lowering of the container to the desired depth. Effort free loading can be achieved if a winch or like automated device is employed.

Cord 70 may be marked with depth indicators so that a user can easily ascertain what depth the container is presently located at. Alternatively, depth meter 62, as described previously, can be mounted on locating device 50 such that the length of cord 70 lowered into the borehole is recorded and displayed to the user. Once the desired depth is reached, cord 70 can be tied off to a stake or a peg driven into the ground near the perimeter of the borehole. In boreholes which contain water container 10 will be supported by the water and so will exert little dead weight on the peg or stake.

Locating device 50 can then be removed and the borehole has been appropriately charged with explosives and is ready for firing. Legs 51 of locating device 50 conveniently fold together and may be held in this position by a looping of chains 54 around the legs. Locating device 50 can then be picked up by handle 55 and carried to the next borehole for further explosive placement. If a crane or like arm mounted on a vehicle is used then the arm is simply swung back in within the limits of the vehicle tray and the operator can drive to the next borehole.

In the manner described container 10 can be filled with explosives and lowered to and maintained at a desired depth in a borehole to achieve the best explosion profile. Injury and workplace health and safety issues are avoided by the use of locating device 50 described which at all times supports the bulk of the weight of the explosives and allows easy and controlled lowering. Once one container 10 has been placed and tied off then subsequent containers 10 can be placed at increasing heights within the borehole until the desired amount of explosives has been placed.

This method allows the placement of explosives without the need for filler material such as gravel between explosive charges. This greatly reduces the manual labour requirement and so the time spent on charging each borehole. The container 10 and associated method of lowering it into a borehole are equally useful in wet or dry boreholes and may be used alone, as described, or in combination with existing decking products.

Container 10 itself overcomes the deficiencies of the prior art by at all times maintaining the booster adjacent the explosives composition due to the provision of booster compartment 14. This will result in more reliable initiation of the explosives composition by the booster. Elongate sheath 13 protects the detonator cord to ensure it remains adjacent and/or contacts the booster to trigger the explosion of the booster composition. In this manner the combination of features provided by container 10 results in more reliable firing of the explosive charge. This will provide for an improved safety profile due to certainty of blasting and will save time as fewer boreholes will need to be dewatered and/or re-drilled. Further, the use of a water resistant inner bag 11 in combination with outer bag 12 means the integrity of the explosive composition is maintained meaning splitting is less likely and reducing the consumption of costly explosive material.

Although the discussion of the container 10 and method of locating it in a borehole has been described herein by way of reference to pre-splitting blasting it will be appreciated by a person of skill in the art that the applicability of same is much wider than that. Container 10 is suitable for use in any blasting operation where it is important to ensure that the booster is intimately located with the explosives compositions and particularly where there is a risk that it may be displaced therefrom. Likewise the method of locating container 10 using locating device 50 will be useful for lowering an explosive charge into any man made or natural hole or fissure.

Throughout the specification the aim has been to describe the preferred embodiments of the invention without limiting the invention to any one embodiment or specific collection of features. It will therefore be appreciated by those of skill in the art that, in light of the instant disclosure, various modifications and changes can be made in the particular embodiments exemplified without departing from the scope of the present invention.

The invention claimed is:

1. An explosives container comprising:

a puncture resistant flexible outer bag comprising a first end and a second end;

a flexible inner bay located within the outer bay for containing an explosive;

an elongate sheath adapted to house a detonator cord, the elongate sheath extending substantially between the first end and the second end of the outer bag; and a booster compartment, separate from the elongate sheath, adapted to contain an explosive booster, the booster compartment located on an external surface of the outer bag, adjacent the second end.

2. The explosives container of claim 1 wherein the outer bag is elongate.

3. The explosives container of claim 1 wherein the elongate sheath is provided with an opening at its upper and lower extent.

4. The explosives container of claim 3 wherein at least one of the openings is adapted to receive a whole human hand.

5. The explosives container of claim 1 wherein the outer bag has a resealable opening at the first end and is sealed at the second end.

6. The explosives container of claim 5 wherein the first end of the outer bag is provided with a releasable fastener to close the opening therein.

7. The explosives container of claim 1 wherein the inner bag is water resistant.

8. The explosives container of claim 1 wherein the inner bag has a releasable opening at its upper extent, corresponding to the opening of the outer bag, and is sealed at its lower extent.

9. The explosives container of claim 8 wherein the inner bag is provided with a releasable fastener to close the opening therein.

10. The explosives container of claim 9 wherein, when the releasable fastener is tensioned, the inner bag is adapted to substantially prevent the release of any explosives composition located therein.

11. The explosives container of claim 1 further comprising a pouch, separate to the elongate sheath, within which the booster compartment is located.

12. The explosives container of claim 1 further comprising a secondary sheath, separate to the elongate sheath, adapted to house a detonator cord, the secondary sheath located between the booster compartment and the second end of the outer bag.

13. The explosives container of claim 1 further comprising a plurality of spaced apertures formed in the first end of the outer bag.

14. The explosives container of claim 1 wherein the booster compartment is provided with a releasable opening adjacent a lower extent of the elongate sheath and the opening is provided with a releasable compartment fastener.

15. A method of locating an explosive composition and associated initiating device in a borehole including the steps of:

placing the explosive composition into a flexible inner bag, the inner bag located within a puncture-resistant flexible outer bag and the outer bag having a first end and a second end and a booster compartment located on an external surface of the outer bag adjacent the second end and an elongate sheath extending substantially between the first end and the second end, the booster compartment being separate from the elongate sheath;

locating a detonation cord within the elongate sheath;

placing an explosives booster into the booster compartment; and lowering the outer bag into the borehole.

16. The method of claim 15 further comprising the step of providing a locating device comprising a tensioning device and a line support and suspending the outer bag on the locating device over the borehole.

17. The method of claim 16 further comprising the step of attaching a first end of a line to the first end of the outer bag, the line being frictionally engaged with the line support and a second end of the line being releasably attached to the tensioning device.

18. The method of claim 17 further comprising the step of releasing the second end of the line from the tensioning device and allowing the line to continue to pass through the line support in a controlled fashion.

* * * * *